US012540622B1

(12) United States Patent
Jimenez

(10) Patent No.: US 12,540,622 B1
(45) Date of Patent: Feb. 3, 2026

(54) DOUBLE-SUCTION SPLIT CASE MULTI-DISC PUMP

(71) Applicant: MXQ, LLC, Houston, TX (US)

(72) Inventor: Juan Jimenez, Houston, TX (US)

( * ) Notice: Subject to any disclaimer, the term of this patent is extended or adjusted under 35 U.S.C. 154(b) by 0 days.

(21) Appl. No.: 19/191,128

(22) Filed: Apr. 28, 2025

(51) Int. Cl.

| | |
|---|---|
| ***F04D 1/00*** | (2006.01) |
| ***F01D 1/36*** | (2006.01) |
| ***F04D 5/00*** | (2006.01) |
| ***F04D 29/18*** | (2006.01) |
| ***F04D 29/22*** | (2006.01) |

(52) U.S. Cl.
CPC ..... *F04D 1/006* (2013.01); *F01D 1/36* (2013.01); *F04D 5/001* (2013.01); *F04D 29/185* (2013.01); *F04D 29/2222* (2013.01)

(58) Field of Classification Search
CPC ..... F04D 1/006; F04D 5/001; F04D 29/185; F01D 1/36
See application file for complete search history.

(56) References Cited

U.S. PATENT DOCUMENTS

| | | | | |
|---|---|---|---|---|
| 4,773,819 | A | 9/1988 | Gurth | |
| 5,355,993 | A | 10/1994 | Hay | |
| 5,385,443 | A | 1/1995 | Dufour | |
| 5,551,553 | A | 9/1996 | Hay | |
| 6,375,412 | B1 * | 4/2002 | Dial | F04D 29/2238 416/198 A |
| 7,044,288 | B2 | 5/2006 | Baer et al. | |
| 7,553,124 | B1 | 6/2009 | Jimenez | |
| 8,210,816 | B2 | 7/2012 | Geldenhuys | |
| 11,680,578 | B1 | 6/2023 | Jimenez | |
| 2001/0014290 | A1 * | 8/2001 | Takura | F04D 3/02 417/423.5 |
| 2005/0276681 | A1 * | 12/2005 | Avina | F01D 1/36 415/1 |
| 2006/0216149 | A1 * | 9/2006 | Wilson | F01D 1/34 416/4 |
| 2007/0258824 | A1 | 11/2007 | Pacello et al. | |
| 2008/0213093 | A1 | 9/2008 | Guelich | |
| 2011/0027069 | A1 * | 2/2011 | Couto | F03B 5/00 415/90 |
| 2011/0097189 | A1 * | 4/2011 | Sandoval | F01D 1/36 415/68 |
| 2011/0164958 | A1 * | 7/2011 | Saitoh | F01D 5/028 415/203 |

(Continued)

FOREIGN PATENT DOCUMENTS

| | | | |
|---|---|---|---|
| WO | 2014073976 | A1 | 5/2014 |

*Primary Examiner* — Courtney D Heinle
*Assistant Examiner* — Andrew J Marien
(74) *Attorney, Agent, or Firm* — EGBERT, MCDANIEL & SWARTZ, PLLC

(57) ABSTRACT

An impeller pump has a housing having a suction chamber and a discharge chamber therein, a plurality of discs joined in spaced relationship and positioned within the housing, and a shaft extending through the housing and having an end adapted to be driven by motor so as to be rotated by the motor. The housing has a suction inlet that opens to the suction chamber and a discharge outlet that opens to the discharge chamber. The suction inlet has a pair of flow paths to the suction chamber. The plurality of discs includes a drive disc and a plurality of driven discs. The shaft is affixed to the drive disc such that the plurality of discs rotate within the housing.

19 Claims, 8 Drawing Sheets

(56) References Cited

U.S. PATENT DOCUMENTS

| | | | | |
|---|---|---|---|---|
| 2012/0014779 | A1 | 1/2012 | Gilliam | |
| 2015/0308446 | A1 | 10/2015 | Koivikko et al. | |
| 2020/0191168 | A1* | 6/2020 | Kosmicki ..... | F04D 29/281 |

* cited by examiner

DOUBLE-SUCTION SPLIT CASE MULTI-DISC PUMP

CROSS-REFERENCE TO RELATED APPLICATIONS

Not applicable.

FIELD OF THE INVENTION

The present invention relates to disc pumps. More particularly, the present invention relates to the impellers for moving fluids associated with such disc pumps. More particularly, the present invention relates to double-suction multi-disc pumps.

BACKGROUND OF THE INVENTION

Boundary layer or bladeless turbines, pumps, and other related turbo-machinery have been known for one hundred years or more. Nikola Tesla obtained a patent (U.S. Pat. No. 1,061,142) for such a device in 1913. The Tesla patent disclosed a multiple-disc pump that utilized rotating flat discs with no blades, vanes, or propellers. Such pumps have been referred to as disc pumps, boundary layer pumps, or bladeless pumps.

In U.S. Pat. No. 1,061,206, Tesla disclosed a fluid-driven boundary layer or bladeless turbine which may be utilized as a prime mover in various applications. The Tesla bladeless turbine, when used as the driving force for a hydro-electric generator, could transform the kinetic energy of a flowing fluid into electrical energy. In U.S. Pat. No. 1,329,559, Tesla disclosed another application of the bladeless turbine, this time in an internal combustion engine. The Tesla patent show early disclosures of rotational machines using bladeless or boundary layer discs.

Unlike more traditional centrifugal pumps which utilize vanes, blades, augers, buckets, pistons, gears, diaphragms, and the like, boundary layer pumps, such as those described by Tesla, typically utilize multiple rotating parallel discs. Disc pumps, as these machines are sometimes called, utilize the fluid properties of adhesion and viscosity. These fluid properties combine to create an interaction between the fluid and the rotating flat discs that allow the transfer of mechanical energy from the rotating discs to the fluid.

Boundary layer or disc pumps (both names are used in the industry and both are used interchangeably) have been reported to have advantages over traditional pumps, especially when utilized for pumping fluids other than cool, clean, homogenous liquids. The vanes, buckets, or the like, of traditional pumps wear and lose effectiveness due to normal friction and/or impingement with particles (such as sand or other abrasives). However, the flat surfaces of boundary layer pumps are much less susceptible to wear. It is not unusual for such a pump to show little or no wear even after extended use.

Disc pumps have been found to be especially effective for pumping high viscosity fluids wherein the efficiency of such pumps may actually increase as the fluid viscosity increases. Disc pumps have also been reported to be more cost-effective in terms of reliability and decreased downtime for pumping problematic multiphase fluids, which may comprise gases, liquids, and/or solid materials. Disc pumps have been found to greatly reduce maintenance costs and downtime when used to replace more traditional pumps in these demanding settings.

Traditional centrifugal pumps have vanes which are designed to shear and sling the liquid in order to impart centrifugal force. These typical centrifugal pumps have problems with cavitation, clogging, binding, and high wear when used for pumping slurries, liquids with solids, high viscosity fluids, and fluids with entrained air or gas. Because of the shortcomings, centrifugal pumps are available with modified impellers which have no vanes or have fractional vanes to avoid complete impingement on the liquid. These are also known as disc pumps. Disc pumps are commonly chosen to transport liquids with slurries having a great amount of solids, high viscosity, and slurries with entrained air or gas. They are also used to pumps the shear-sensitive liquids and to prevent emulsification or degradation of the liquid.

A disc pump is comprised of an outer housing with an inner cylindrical rotor chamber having an inlet at one end and an outlet at its outer periphery. A rotor assembly in the chamber is composed of at least two parallel spaced discs disposed co-axially in the chamber and connected together for rotation about the center axis. The inner opposing faces of the discs are spaced a pre-determined distance apart and a series of raised ribs or vanes are provided on at least one of the opposing faces when the vane height is less than the disc spacing. The first disc is known as the drive disc and is attached to the pump shaft. The other discs are attached to the drive disc via pins or posts. The drive disc is solid. The additional disc has a hole in the center to allow the liquid to enter.

The inherent design of a disc pup removes typical vanes from the impeller and uses friction dragged or surface tension to propel the liquid. This design creates slippage and is very inefficient. Some disc pump designs have incorporated rectangular ribs to make the discs more efficient. These ribs start at the center of the disc and extend to the outer diameter of the disc. Despite these modifications, these improvements are still highly inefficient because of dead zones created by vortices on the back of the rectangular ribs and lack of surface area to propel the liquid in a laminar manner.

FIGS. 1-3 show a particular structure of the rotary disc pump. FIGS. 1-3 are described in U.S. Pat. No. 4,940,385, issued on Jul. 10, 1990 to M. I. Gurth. FIGS. 1 and 2 illustrate a rotary disc pump 10 for pumping various types of fluids, including relatively abrasive slurries or fluids having solid contents, highly viscous fluids, and fluids having entrained gas contact. The pump basically comprises a housing 12 having an inner cylindrical rotor chamber 14 in which a rotor assembly 16 for pumping fluid through the pump is rotatably mounted. Chamber 14 has an inlet 18 at one end and an outlet 20 extending generally tangentially from the outer periphery of the chamber.

The rotor assembly 16 is illustrated in FIGS. 2 and 3 and comprises a pair of parallel, spaced discs 22, 24 disposed coaxially in the rotor chamber 14. The first disc 22 at the inlet of the chamber has a central opening 26 aligned with inlet 18 for allowing fluid to flow from the inlet into the spacing between the discs. The first disc is connected to the second or drive disc 24 via a plurality of pins or connectors 28 spaced around and closely adjacent to the axis of the discs. The drive disc 24 is connected on its outer face 30 to a suitable driveshaft 32, which is connected to a motor (not shown) for driving the assembly.

Each disc 22, 24 has a plurality of generally radially extending vanes or ribs 34, 35 on each of its faces, which extend from the outer periphery of the disc towards the center. The ribs 34, 35 have bars of generally rectangular cross-section welded to the opposite faces of each disc. Eight vanes are provided on each disc face at equal intervals. The vanes 34, 35 on the opposing disc faces are in alignment, as shown in FIG. 3. The discs 22, 24 are spaced a predetermined distance apart, depending on the characteristics of the fluid to be pumped. The combined height of the opposing vanes on the interfaces of the discs is less than the disc spacing so as to leave a large gap between the opposing inner vanes (as shown in FIG. 2). This gap depends on the characteristics of the fluid being pumped. The vanes or ribs are straight and of uniform width. The vanes extend up to or close to the center opening 26 in disc 22 and are of equivalent or slightly greater length on disc 24. The inner ends 38 of the vanes are pointed or tapered as illustrated to provide more clearance for fluid to pass between the vanes where they converge together towards the center of each disc.

In operation, fluid enters the pump through the inlet conduit and proceeds to the spacing between the opposing disc faces. As the discs rotate, the fluid will proceed radially outwardly to the outer portions of the disc by a combination of friction and pressure gradients, along with viscous drag created by the rotating discs enhanced by the action of the vanes. This adds to the profile or form passing through the fluid and thus increases the form drag. The fluid is then discharged through the outlet which is located on an area of the peripheral wall of the chamber between the two discs.

In the past, various patents and patent application publications have issued with respect to such centrifugal or disc pumps. For example, U.S. Pat. No. 1,013,248, issued on Jan. 2, 1912, describes a centrifugal pump which is the combination of a pump casing, a rotatable shaft mounted therein, and a series of friction or impeller discs carried by the shaft. Curved vanes are secured between the impeller discs near the periphery thereof. The vanes overlap each other, but leave a gradually narrowing space from the center outwardly. The impeller discs have interior rounded edges and a means for fastening the impeller structure together.

U.S. Pat. No. 4,773,819, issued on Sep. 27, 1988 to M. I. Gurth, describes a rotary disc slurry pump that includes a rotary pump having a plain disc impeller disposed in a cylindrical chamber of a housing with an inlet coaxial of the impeller into the housing and a substantially square outlet from the periphery of the chamber. A rotor is arranged to provide a substantially unobstructed passage between the inlet and the outlet of the pump.

U.S. Pat. No. 5,355,993, issued on Oct. 18, 1994 to A. G. Hay, teaches an apparatus for transporting and metering particulate material. This apparatus includes a transport duct having an inlet, an outlet, and at least one moving surface located therebetween and having a downstream facing drive surface. A motive device for moving the moving surface between the inlet and the outlet is provided. The particulate matter is compacted sufficiently to cause the formation of a bridge composed of substantially interlocking particulates spanning the width of the transport duct. The bridging of the particulates causes the particulates to become semi-hydrostatic in nature such that the force exerted by the downstream facing drive surface upon the particulates within the transport duct drives the entire mass of material through the transport duct toward the outlet.

U.S. Pat. No. 5,385,443, issued on Jan. 31, 1995 to R. Dufour, shows a centrifugal liquid pump of the rotary disc type that incorporates a gas injection assembly. The gas injection assembly allows up to 15% per volume of the gas to be mixed with the pumped liquid. The gas injection is achieved with a gas feed pipe that enters the pump to its axial inlet with a plurality of gas injectors that project from the gas feed pipe radially within the impeller.

U.S. Pat. No. 5,551,553, issued on Sep. 3, 1996 to A. G. Hay, discloses an apparatus for transporting particulate material. A housing is provided and includes a wall defining an inlet and a wall defining an outlet space downstream from the outlet. A duct is enclosed in the housing between the inlet and the outlet. The duct is formed between first and second substantially opposed drive walls movable relative to the housing from the inlet toward the outlet and at least one arcuate wall extending between the inlet and the outlet. The drive walls have a greater surface area for contacting the solid material than the arcuate walls. The drive walls rotate relative to an axis. An assembly is provided for positioning the second drive wall in the housing for rotation in a plane at an angle relative to the axis such that the distance between the first and second drive walls adjacent to the inlet is greater than the distance downstream from the inlet when the drive walls are moving.

U.S. Pat. No. 7,044,288, issued on May 16, 2006 to Barer et al., shows a bulk material pump having a housing and a rotatable drive rotor for transporting material from an inlet to an outlet of the housing. The drive rotor has a hub. Drive discs extend away from the hub toward an inner wall of a housing. The distance between the circumferential edges of the drive discs and the inner wall of the housing increases from the inlet to the outlet in the direction of rotation of the drive rotor. A low-friction brush seal is disposed on the periphery of the drive discs so as to seal the area between the periphery of the drive discs and the inner wall. A material scraper having a flexible tip is mounted in the housing and extends into the drive rotor between the drive discs.

U.S. Pat. No. 8,210,816, issued on Jul. 3, 2012 to S. Geldenhuys, teaches an impeller for a centrifugal pump. The centrifugal pump includes a pump casing within which an impeller is mounted for rotation, in a cantilever fashion, on a shaft. The casing has an axial inlet and a peripheral volute around the impeller leading to an outlet. The impeller has axially spaced annular sides with radially outwardly arranged, rearwardly curved, vanes between the sides. A clearing that corresponds to sides of the casing is located outwardly of the sides. Auxiliary vanes are provided to generate a pressure gradient to prevent or counteract leakage of working fluid. Leading faces of the auxiliary vanes slope relative to and perpendicular to the sides. The leading edges are at an obtuse angle to the sides.

U.S. Patent Application Publication No. 2007/0258824, published on Nov. 8, 2007 to Pacello et al., provides a rotor for viscous or abrasive fluids. This rotor comprises a drive disc and a plurality of driven discs in a stack. The stacked discs are in spaced relationship along a rotational axis so as to form inter-disc spaces. A centrally-positioned aperture is provided in each of the driven discs so as to open into the inter-disc spaces. A hub is connected to the drive disc for communication with a driveshaft. There is a plurality of axial vanes within the apertures and attached to the discs whereby rotation of the rotor causes the fluids to be drawn into the apertures and then into the inter-disc spaces.

U.S. Patent Application Publication No. 2008/0213093, published on Sep. 4, 2008 to J. Guelich, discloses an impeller for pumps in which a rotary wheel includes an intermediate wall at which one or more vanes are provided on each side thereof. Passage openings are formed in the intermediate wall in order to distribute a desired pump flow into the vanes on both sides of the intermediate wall.

U.S. Patent Application Publication No. 2012/0014779, published on Jan. 16, 2012 to C. D. Gillim, teaches a disc pump having one or more rotating discs within a housing. The discs have a plurality of relatively small surface perturbations covering at least one-half of one side of their surface. The perturbations may be recessed or raised. In operation, a boundary layer is formed near the surface of the rotating discs. The fluid within the pump flows in a circular and outward direction, thus moving the fluid from a central coaxial inlet to an outlet located at the peripheral wall of the housing. The surface perturbations produce turbulence within the boundary layer during operation.

U.S. Patent Application Publication No. 2015/0308446, published on Oct. 29, 2015 to Koivikko et al., shows an impeller for a centrifugal pump in which the impeller includes a front shroud, a rear shroud, and one or more working vanes therebetween. The front shroud has a front surface opposite to the face having the working vanes. The rear shroud has a rear face opposite to the face having the working vanes. The front shroud has an outer circumference of the plurality of front pump-out vanes attached to the front face of the front shroud. The rear shroud has a plurality of rear pump-out vanes attached to the rear face of the rear shroud.

International Publication No. WO2014/073976, published on May 15, 2014 to S. Ree, discloses an impeller for a centrifugal pump for pumping drill fluid containing cuttings. The impeller has a rear side wall and a front side wall. Arranged between the rear side wall and the front side wall is a number of vanes with an outer edge and a vane with in the axial direction. At least one of the periphery of the rear side wall or the periphery of the front side wall projects by radial distance beyond the outer edge of the vanes. The radial distance is at least 0.5 times the vane width.

U.S. Pat. No. 7,553,124, issued on Jan. 30, 2009 to the present inventor, describes a pump for pumping high-viscosity liquids, slurries and liquids containing solids. The pump has a housing, a chamber formed within the housing, a first discoidal member positioned in the chamber, a second discoidal member positioned in the chamber, connecting rods connecting a periphery of the first discoidal member to a periphery of the second discoidal member, and a drive for rotating the first discoidal member and the second discoidal member within the chamber. The first discoidal member is either a recessed impeller or half-regular closed centrifugal impeller. The second discoidal member is a recessed impeller, a disc impeller, or half-regular closed centripetal impeller. The second discoidal member has a hole in the center thereof.

U.S. Pat. No. 11,680,578, issued on Jun. 20, 2023 to the present inventor, shows an impeller for a disc pump. This impeller has a drive disc with a connector for joining to a shaft of the disc pump, a driven disc affixed to the drive disc so as to define a space therebetween, and a plurality of wing vanes formed in the face of at least one of the drive disc and the driven disc. The drive disc has a face facing the face of the driven disc. The drive disc extends in generally parallel planar relationship to the driven disc. The plurality of wing vanes radiate across the surface toward an outer diameter of one of the drive disc and the driven disc. Each of the plurality of wing vanes has a portion extending outwardly beyond the outer diameter of the drive disc and the driven disc.

It is an object of the present invention to provide a double-suction split case multi-disc pump that converts a double-suction horizontal split case centrifugal impeller into a double-suction horizontal split case multi-disc pump.

It is another object of the present invention to provide a double-suction split case multi-disc pump that provides for a more laminar flow of fluids therethrough.

It is another object of the present invention to provide a double-suction split case multi-disc pump that has improved efficiency.

It is another object of the present invention to provide a double-suction split case multi-disc pump that moves greater volumes of fluids with slurries, solids, high-viscosity fluids and fluids that are entrained with air.

It is another object of the present invention to provide a double-suction split case multi-disc pump that is very compact.

It is another object of the present invention to provide a double-suction split case multi-disc pump that minimizes the carbon footprint.

It is another object of the present invention to provide a double-suction split case multi-disc pump that promotes even loading.

It is still another object of the present invention to provide a double-suction split case multi-disc pump that has a greater discharge pressure.

These and other objects and advantages of the present invention will become apparent from a reading of the attached specification and appended claims.

SUMMARY OF THE INVENTION

The present invention is an impeller pump that has a housing having a suction chamber and a discharge chamber therein, a plurality of discs joined together in spaced relationship and positioned within the housing, and a shaft extending through the housing and having an end adapted to be driven by motor so as to be rotated by the motor. The housing has a suction inlet that opens to the suction chamber and a discharge outlet that opens to the discharge chamber. The suction inlet has a pair of flow paths to the suction chamber. The plurality of discs include a drive disc and a plurality of driven discs. The shaft is affixed to the drive disc such that the plurality of discs rotate within the housing in correspondence with the rotation of the shaft by the motor.

An interior of the plurality of discs opens to the suction chamber and a periphery of the plurality of discs opens to the discharge chamber. The suction inlet has a diameter greater than a diameter of the suction outlet. The suction inlet has a wall therein. This wall is adapted to split a flow of the fluid into the pair of flow paths.

The housing is split so as to have a pump seat and a pump cover. The plurality of discs are seated in the pump seat. The plurality of discs are centered on the shaft. The shaft has bearings therein or interposed between the housing and the shaft.

The drive disc is positioned centrally in a sandwiched arrangement with the driven discs. The driven disc that has at least a pair of internal discs on opposite sides of the drive disc and a pair of external discs on opposite sides of the at least a pair of internal discs. Each of the pair of internal discs has an internal eye having a diameter greater than a diameter of an internal eye of each of the pair of external discs. The internal discs each has a winglet formed on a surface thereof. The winglet is affixed to a respective surface of each of the pair of external discs. The drive disc has a first winglet on one side thereof and a second winglet on an opposite side thereof. The first winglet is joined to one internal disc of the pair of internal discs. The second winglet is joined to another internal disc of the pair of internal discs. At least one of the pair of external discs and the pair of internal discs and the drive disc has a plurality of radial and angled ribs formed thereon or affixed thereto. This plurality of radial and angled ribs extends from an internal eye of the plurality of discs to a periphery of the plurality of discs.

In an embodiment of the present invention, at least one of the plurality of discs is a chopper disc. This chopper disc has a plurality of cutting ribs extending across a surface thereof. The chopper disc can also have a plurality of teeth formed at an outer periphery thereof.

The present invention is a double-suction horizontal split case multi-disc pump which includes a bottom casting that is the pump seat and a top casting that is the pump cover. The pump also includes a rotating assembly. The pump cover is placed on top of the bottom casting to complete the pump. The two ends of the rotating assembly protrude out of the pump housing and are respectively attached to bearing housings constructed on the bottom casting outside of the wet areas of the pump. The bottom casting is formed with a suction inlet and a discharge outlet on opposite sides thereof. The suction side of the pump connects to a suction chamber and the discharge side connects to a discharge chamber. Both sides are distinct and independent.

The rotating assembly is composed of a double-suction multi-disc installed and centered on a shaft with a pair of mechanical seals, a pair of bearings and appropriate gaskets placed on each end so as to allow the assembly to seat inside the pump housing. The multiple discs are centered in the middle of the suction chamber so that it has suction from both sides. The disc is composed of different designs according to the product being handled. Each disc can have a specialized geometry adapted to the product being handled. For example, a chopper disc can be used for wastewater. This chopper disc has sharpened cutting ribs for macerating sewage. A hybrid disc can also be used which blends radially straight and angled ribs that increase the area for force to be generated and thus efficiency. All the discs are connected by a winglet posts. In another embodiment, the pump can be rotated 90° in which the motor is stacked on top so that the present invention becomes a vertical split case configuration with the same internal design.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
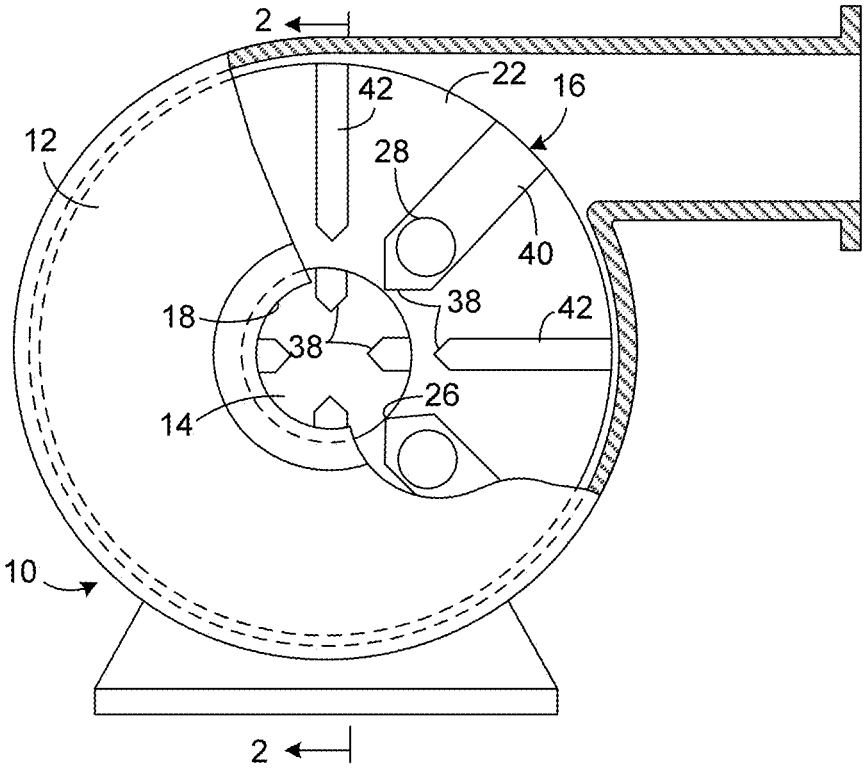
FIG. 1 PRIOR ART
FIG. 1 is a cross-sectional view showing the disc pump of the prior art.
Figure 2:
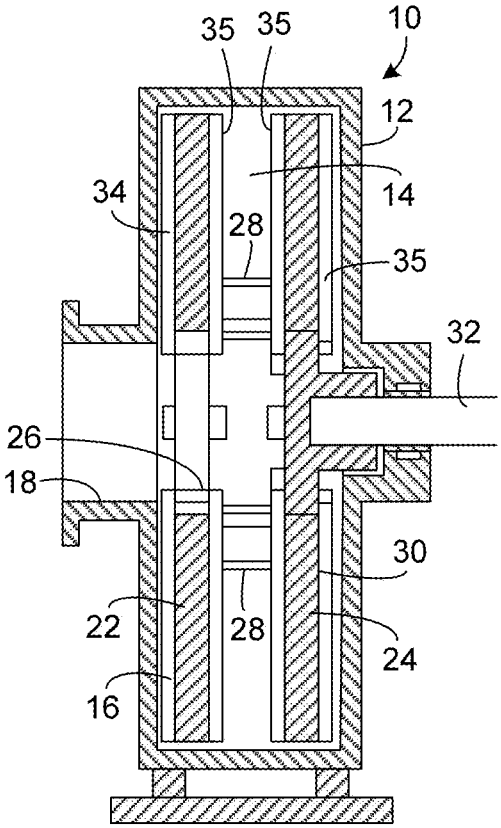
FIG. 2 PRIOR ART
FIG. 2 is a cross-sectional view taken across lines 2-2 of FIG. 1 of the disc pump of the prior art.
Figure 3:
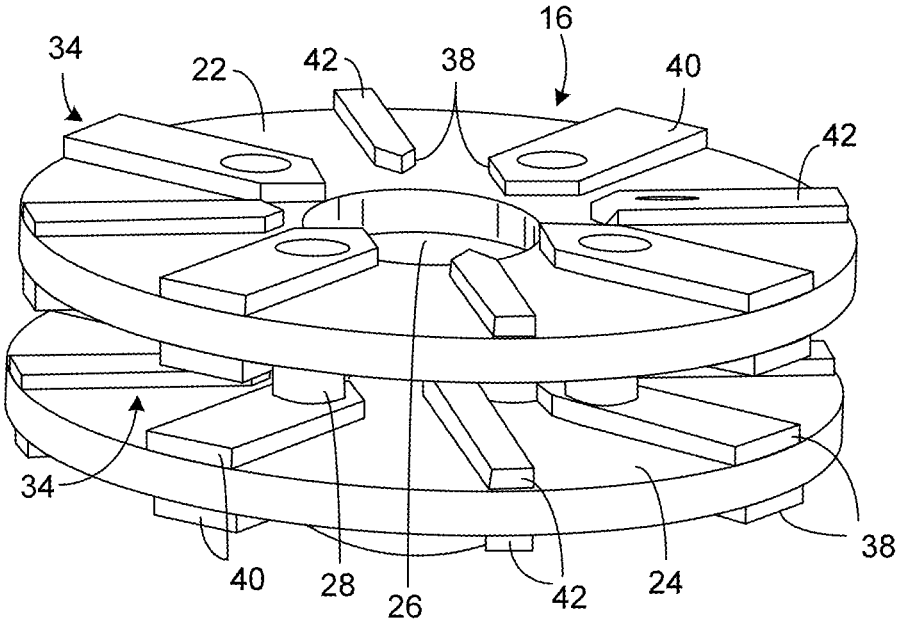
FIG. 3 PRIOR ART
FIG. 3 is an upper perspective view of the impeller is used in the disc pump of the prior art.
Figure 4:
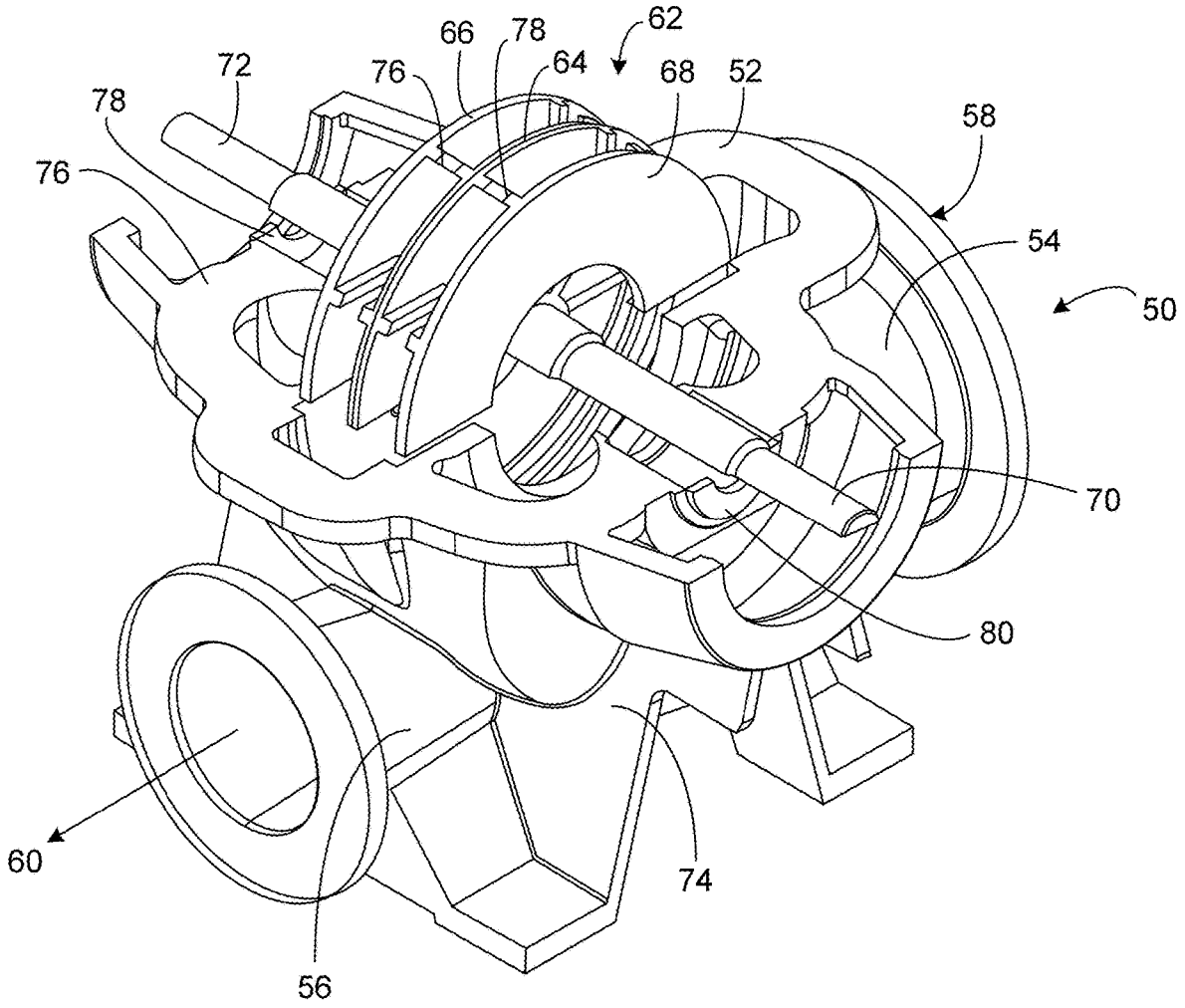
FIG. 4 is an upper perspective view of the double-suction split case multi-disc pump of the present invention with the pump cover removed.

Referring to FIG. 4, there is shown the double-suction split case multi-disc pump 50 of the present invention. In particular, FIG. 4 shows a housing 52 having a suction chamber 54 and a discharge chamber 56 therein. The housing 52 has a suction inlet 58 opening to the suction chamber 54 and a discharge outlet 60 that opens to the discharge chamber 56. The suction inlet 58 will have a pair of flow paths to the suction chamber 54 (to be described hereinafter). A plurality of discs 62 are joined together in spaced relationship. The plurality of discs 62 includes a drive disc 64 and a plurality of driven discs 66 and 68. A shaft 70 extends through the housing 52 and has an end 72 adapted to be driven by a motor so as to be rotated by the motor. The shaft 70 is affixed to the drive disc 64 such that the plurality of discs 62 rotate within the housing 52.

In FIG. 4, can be seen that the housing 52 includes a pump seat 74 and a pump cover surface 76. This contributes to the "split case" configuration of the present invention. Bearings 78 and 80 are positioned on the pump seat 74 so as to be interposed between the shaft 70 and the housing 52. The bearings 78 and 80 support the shaft 70 within the housing 52.

The plurality of discs 62 form a rotary assembly that is positioned over the pump seat 74. As can be seen, the drive disc 64 of the plurality of discs 62 is centered between the driven discs 64 and 68. The drive disc 64 can be connected to the driven discs 68 by winglets 76 and 78. As such, as the shaft 70 rotates the drive disc 64, the driven discs 66 and 68 will correspondingly rotate. This will cause the fluid to pass from the suction inlet 58 to the discharge outlet 60.

Figure 5:
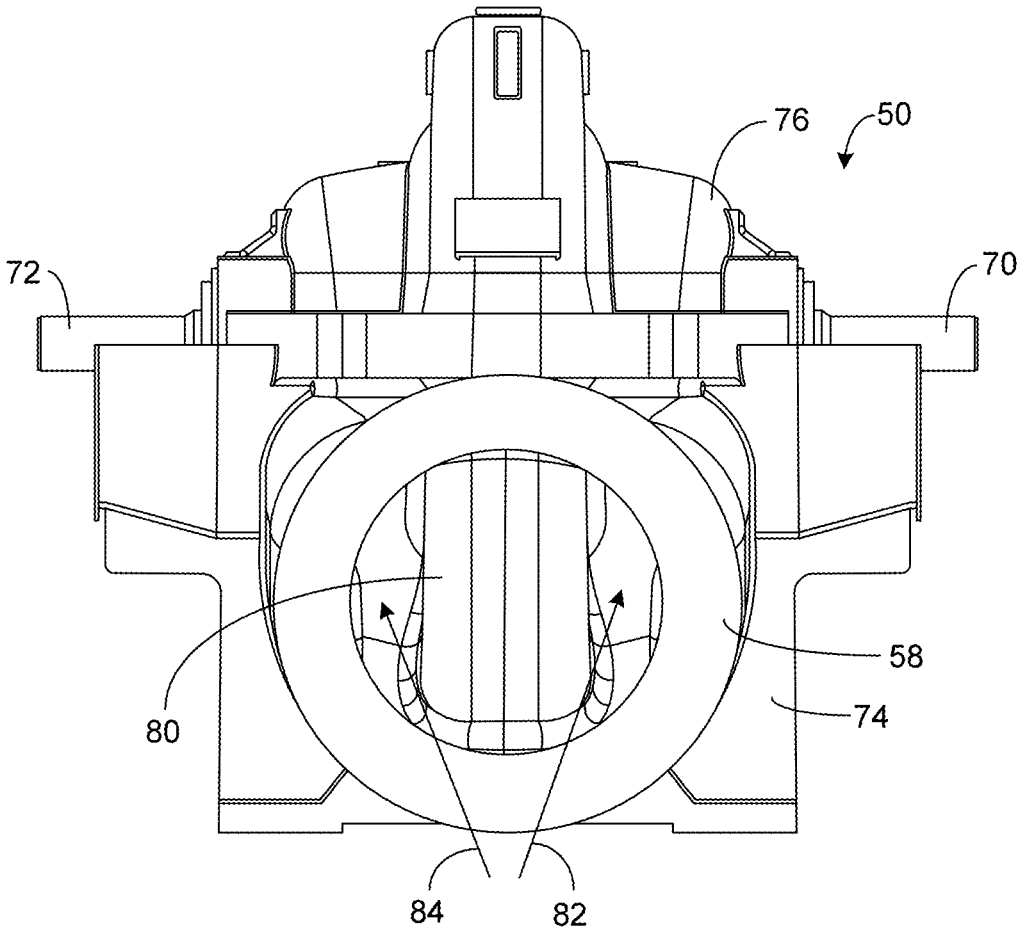
FIG. 5 is an upper perspective view showing the suction inlet of the double-section split case multi-disc pump of the present invention and, in particular, showing the pair of flow paths.

FIG. 5 illustrates the configuration of the suction inlet 58. A wall 80 is formed in the suction inlet 58 so as to split the fluid flow into a pair of flows 82 and 84. This pair of flows will cause the fluid entering the suction inlet 80 to passed to the suction chamber 54 (to be described hereinafter). FIG. 5 further shows that the shaft 70 has an end 72 adapted to be driven by a motor so that the plurality of discs 62 can be driven in rotation. The pump cover 76 is affixed to the pump seat 74 so as to enclose the plurality of discs 62 within the double-suction split case multi-disc pump 50 of the present invention. Within the concept of the present invention, the double-suction split case multi-disc pump can have a horizontal configuration or a vertical configuration. Each of the plurality of discs 62 can be specifically configured for the type of fluid that is to be conveyed through the interior of the pump 50.

Figure 6:
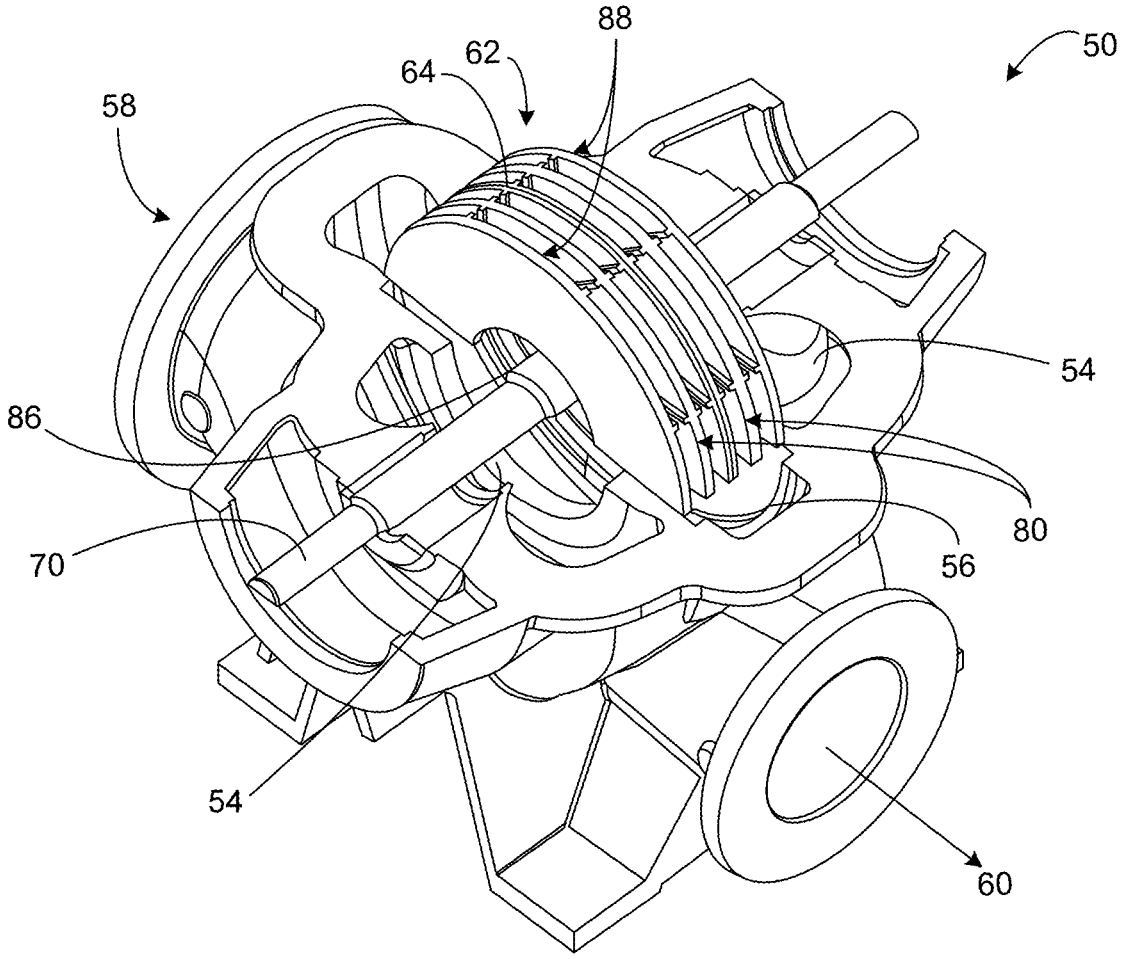
FIG. 6 is an upper perspective view of the double-section split case multi-disc pump of the present invention with the top cover removed and showing, in particular, the configuration of the plurality of discs.

FIG. 6 illustrates an internal view of the double-suction split case multi-disc pump 50 of the present invention. The suction inlet 58 is illustrated as directing a fluid toward the suction chamber 54. The discharge outlet 60 is illustrated as communicating with the discharge chamber 56. Ultimately, the fluid in the suction chamber 54 will be directed toward the interior 86 of the plurality of discs 62. As such, the fluid will pass through the spaces between the plurality of disc 62 so as to be ultimately impelled into the discharge chamber 56 and outwardly through the discharge outlet 60.

FIG. 6 shows, in particular, that the plurality of discs 62 includes a center disc 64, a pair of external discs 88 and a pair of internal discs 90 arranged in a sandwiched configuration. The plurality of discs 62 are arranged in spaced parallel planar relationship. The rotation of the plurality of discs 62 by the shaft 70 can cause the fluid to flow from the suction chamber 54 to the spaces between the plurality of discs 62 and outwardly through the discharge chamber 56 and the discharge outlet 60.

Figure 7:
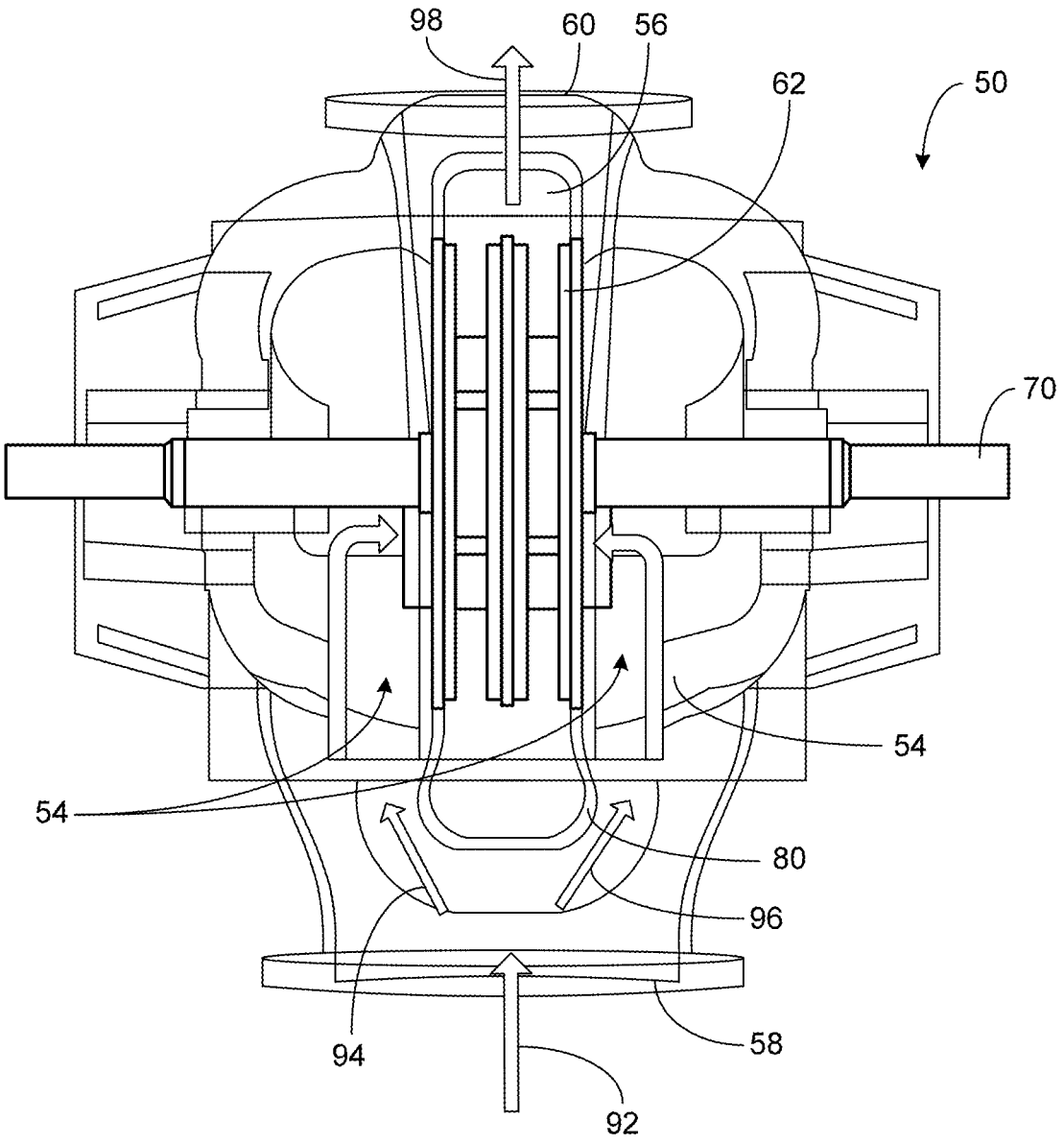
FIG. 7 is a diagrammatic view showing the flow of fluid through the double-suction split case multi-disc pump of the present invention.

FIG. 7 shows, in particular, the flow of fluid through the double-suction split case multi-disc pump 50 of the present invention. Arrow 92 illustrates an initial flow of fluid. This fluid can be in the nature of a slurry, fine solids, high-viscosity fluids and fluids with entrained air. This fluid will enter the suction inlet 58 and be divided into two flow paths 94 and 96 in the suction inlet 58. Wall 80 will divide the flow 92 into the two flow paths 94 and 96. The two flow paths 94 and 96 will then move into the suction chambers 54 so as to be delivered into the interior of the plurality of discs 62. The rotation of the plurality of discs 62 by the rotation of the shaft 70 will impel the fluids through the spaces between the plurality of discs 62 and outwardly through the discharge chamber 56 and the discharge outlet 60 (as illustrated by arrow 98).

Figure 8:
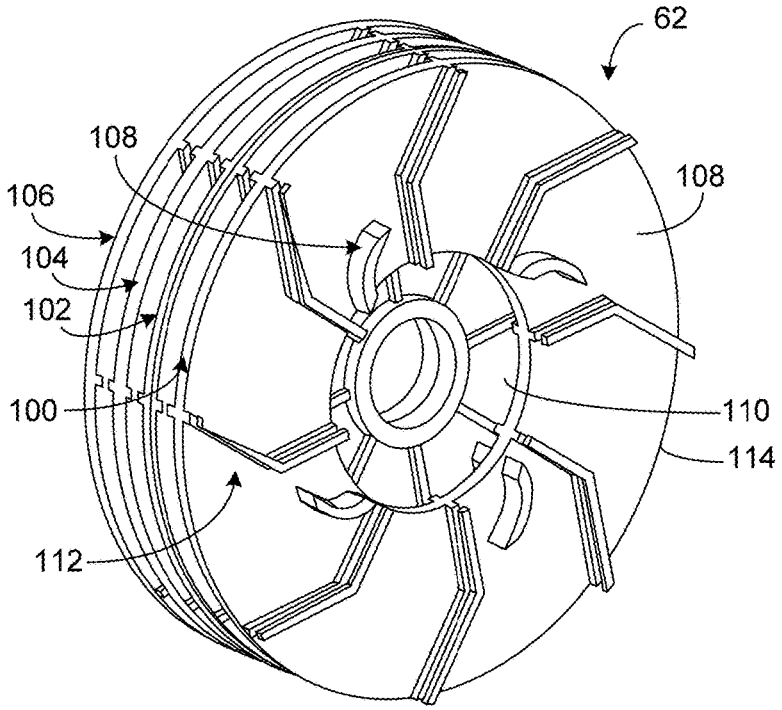
FIG. 8 is an upper perspective view of the plurality of discs as used in the double-suction split case multi-disc pump of the present invention and, in particular, showing the configuration of winglets and ribs on the surface of the discs.

FIG. 8 is an isolated view showing the plurality of discs 62 as used in the double-suction split case multi-disc pump 50 of the present invention. For illustration purposes, one of the external discs 88 has been removed. As such, FIG. 8 shows one internal disc 100, the drive disc 102, another internal disc 104 and an external disc 106 arranged in a sandwiched configuration.

The surface of the internal disc 100 has a winglet 108 formed thereon or affixed thereto. Winglet 108 is has a generally arcuate configuration extending from the internal eye 110 of the internal disc 100. These winglets 108 can be affixed to an internal surface of an external disc. The drive disc 102 can have a first winglet on one side thereof and a second winglet formed on an opposite side thereof. Each of these winglets will have a configuration similar to that of winglet 108. The first winglet is joined to an opposite side from surface 108 of the internal disc 100. The second winglet is joined to the surface of the other internal disc 104. A similar arrangement of winglets 108 can also be applied so as to secure the external disc 106 to the internal disc 104.

The internal disc 100 has a plurality of radial and angled ribs 112 formed or affixed to surface 108. Each of those plurality of radial and angled ribs 112 extends from the internal eye 110 to a periphery 114 of the internal disc 100. A similar arrangement of such radial and angled ribs can also be applied to the respective surfaces of the drive disc 102, the other internal disc 104 and the interior surface of the external disc 106. The winglet 108 is illustrated as located between adjacent pairs of the plurality of radial and angled ribs 112.

Figure 9:
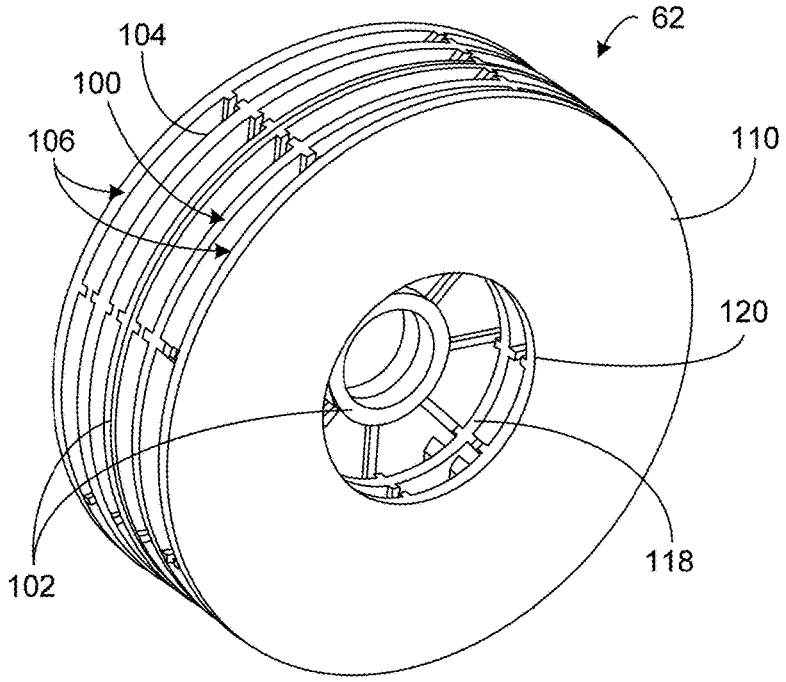
FIG. 9 is an upper perspective end view showing the internal eyes of the external discs in relation to the internal discs of the plurality of discs of the double-suction split case multi-disc pump of the present invention.

FIG. 9 illustrates a further configuration of the plurality of disc 62. In this configuration, there is an external disc 116 that is affixed to the winglets 108 of the internal disc 100. The internal disc 100 is affixed to the drive disc 102. Drive disc 102 is affixed to the other internal disc 104. Ultimately, the internal disc 104 is affixed to the external disc 106 so as to complete the rotating assembly of the plurality of discs 62.

FIG. 9 shows, in particular, that the internal eye 118 of the internal disc 100 has a greater diameter than the internal eye 120 of the external disc 116. A similar arrangement exists between the internal eyes of the internal disc 100 and the external disc 106.

Figure 10:
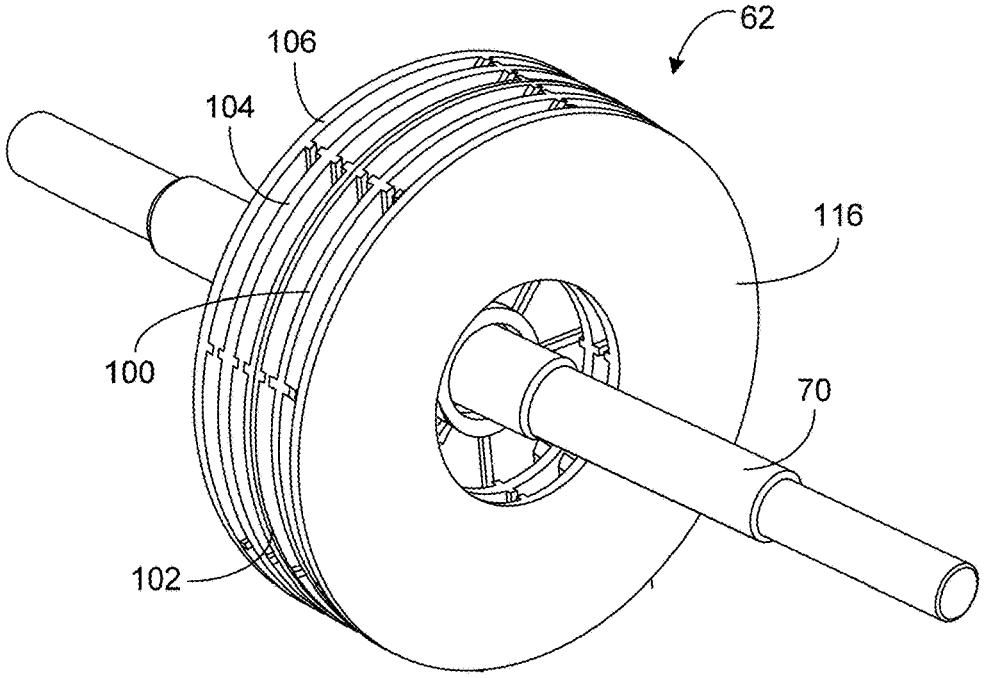
FIG. 10 is an upper perspective view of the plurality of discs as mounted on the shaft.

FIG. 10 shows that the plurality of discs 62 are mounted to the shaft 70. The drive disc 102 will be directly affixed to the outer periphery of the shaft 70. The internal discs 100 and 104 are affixed to the drive disc 102 by the winglets 108 (as described herein previously). The internal discs 100 and 104 will be affixed to the respective external discs 106 and 116 by the respective winglets 108. As such, the rotation of the shaft 70 will cause a corresponding rotation of the plurality of discs 62.

Figure 11:
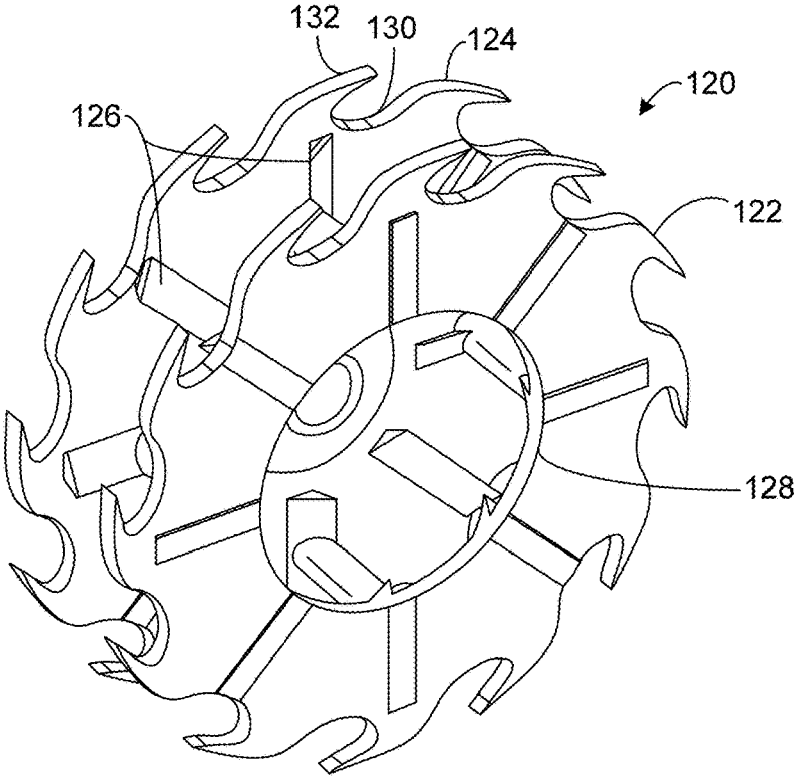
FIG. 11 is an upper perspective view showing a chopper as used among the discs of the plurality of discs of the double-section split case multi-disc pump of the present invention.

FIG. 11 shows an alternative embodiment of the present invention wherein at least one of the plurality of discs 62 is a chopper disc 120. As illustrated in FIG. 11, chopper disc 120 includes a first chopper disc 122 and a second chopper disc 124. These can be configured as either the internal discs or the external discs. Alternatively, each of the discs used in the plurality of discs 62 can be in the nature of the chopper discs 122 and 124.

The chopper disc 120 has a plurality of cutting ribs 126 extending across a surface of the chopper disc 124. This plurality of cutting ribs 126 will have a sharp edge which serves to macerate any fluids passing through the spaces between the respective discs 122 and 124. Each of the cutting ribs 126 will extend from the internal eye 128 to the outer periphery 130 of the chopper discs 122 and 124.

The chopper discs 122 and 124 are also illustrated as having a plurality of teeth 132 formed at the outer periphery 130 of each of the chopper discs 122 and 124. Once again, these teeth 132 can be sharp so as to further macerate any fluids passing through the impeller pump of the present invention.

As shown herein, FIG. 4 is a complete overview of the double-suction horizontal split case multi-disc pump of the present invention having a bottom casting identified as the "seat" and a top casting identified as the "cover" in which these are assembled together. The rotating assembly is installed. The shaft extends outwardly of the cover in order to be supported by the bearing seating area. The suction is the largest flange on the right. The discharge is the smaller flange on the left. FIG. 5 shows that the suction flange has an internal wall with a pair of suction chambers. This pair of suction chambers is on each side of the plurality of discs. FIG. 6 shows a cutaway view of the double-suction horizontal split case multi-disc pump resting on the seat or bottom casting. A five disc rotating assembly rests and is centered on the suction side of the pump between the pair of suction chambers. The center disc, which connects to the shaft, is in the middle of the plurality of discs. There is a pair of internal discs and a pair of external discs. The pair of suction chambers, the suction flange and the discharge flange are also illustrated. FIG. 7 shows a transparent top view of the flow path through the pump showing the suction with its suction chambers and discharge.

FIG. 8 shows a hybrid disc set without the closest external disc attached and without the shaft. This is a hybrid disc because it contains radial ribs and also angled ribs that are seamlessly blended together. The radial ribs generate more pressure. The bend-angled ribs generate more flow via a "slinging" effect. This is customary of a typical centrifugal impeller. The bending allows for more surface area to generate more force. Also shown in FIG. 8 are the winglets. These are small arcuate vanes that act as posts that connect the discs together. FIG. 8 shows a pair of internal disc, and external disc and drive disc mounted centrally of the internal discs and the external discs.

FIG. 9 shows a complete five disc assembly. The discs are assembled in the order of: (1) external disc, (2) internal disc, (3) center or driven disc, (4) internal disc, and (5) external disc. The eyes of the internal discs are larger than the eyes of the external discs. This promotes an even loading of the disc of the plurality of disc. This same logic and arrangement can be used for a seven disc-set. The only difference is the number of internal discs. In a seven disc-set arrangement, there would be four internal discs. In a nine disc arrangement there would be six internal discs. FIG. 10 shows a five disc arrangement on a shaft. FIG. 11 shows the chopper disc set which contain sharpened ribs and external diameters for macerating solids and for passing sewage.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

The invention claimed is:

1. An impeller pump comprising:

a housing having a suction chamber and a discharge chamber therein, said housing having a suction inlet opening to the suction chamber and a discharge outlet opening to the discharge chamber, the suction inlet having a pair of flow paths to the suction chamber;

a plurality of discs joined together in spaced relation, said plurality of discs having a drive disc and a plurality of driven discs, said plurality of discs being received within said housing; and a shaft extending through said housing and having an end adapted to be driven by motor so as to be rotated by the motor, said shaft being affixed to the drive disc such that said plurality of discs rotate within said housing, wherein an interior of said plurality of discs opens to the suction chamber and a periphery of said plurality of discs opens to the discharge chamber.

2. The impeller pump of claim 1, wherein the suction inlet has a diameter greater than a diameter of the discharge outlet.

3. The impeller pump of claim 1, wherein the suction inlet has a wall therein, the wall adapted to split a flow of a fluid into the pair of flow paths.

4. The impeller pump of claim 1, wherein said housing is split so as to have a pump seat and a pump cover, the plurality of discs being seated in the pump seat, the pump cover covering the plurality of discs.

5. The impeller pump of claim 1, wherein the plurality of discs are centered on said shaft, said shaft having bearings thereon interposed between said housing and said shaft.

6. The impeller pump of claim 1, wherein at least one of the plurality of discs is a chopper disc, the chopper disc having a plurality of cutting ribs extending across a surface of the chopper disc.

7. The impeller pump of claim 1, wherein at least one of said plurality of discs is a chopper disc, the chopper disc having a plurality of teeth formed at an outer periphery thereof.

8. The impeller pump of claim 1, wherein at least one of the plurality of discs is a chopper disc, the chopper disc having a plurality of cutting ribs extending across a surface of the chopper disc and a plurality of teeth formed at an outer periphery thereof.

9. An impeller pump comprising:

a housing having a suction chamber and a discharge chamber therein, said housing having a suction inlet opening to the suction chamber and a discharge outlet opening to the discharge chamber, the suction inlet having a pair of flow paths to the suction chamber;

a plurality of discs joined together in spaced relation, said plurality of discs having a drive disc and a plurality of driven discs, said plurality of discs being received within said housing; and a shaft extending through said housing and having an end adapted to be driven by motor so as to be rotated by the motor, said shaft being affixed to the drive disc such that said plurality of discs rotate within said housing, wherein the drive disc is positioned centrally in a sandwiched arrangement with the driven discs.

10. The impeller pump of claim 9, wherein the driven disc has a pair of internal discs on opposite sides of the drive disc and a pair of external discs on opposite sides of the pair of internal discs.

11. The impeller pump of claim 10, wherein each of the pair of internal discs has a winglet formed on a surface thereof, the winglet being affixed to a respective surface of each of the pair of external discs.

12. The impeller pump of claim 11, wherein the drive disc has a first winglet on one side thereof and a second winglet formed on an opposite side thereof, the first winglet being joined to one internal disc of the pair of internal discs, the second winglet being joined to another internal disc of the pair of internal discs.

13. The impeller pump of claim 10, wherein at least one of the pair of external discs and the pair of internal discs and the drive disc has a plurality of radial and angled ribs formed thereon or affixed thereto.

14. The impeller pump of claim 13, wherein each of the plurality of radial and angled ribs extends from an internal eye of the at least one of the plurality of discs to a periphery of the at least one of the plurality of discs.

15. An impeller pump comprising:

a housing having a suction chamber and a discharge chamber therein, said housing having a suction inlet opening to the suction chamber and a discharge outlet opening to the discharge chamber, the suction inlet having a pair of flow paths to the suction chamber;

a plurality of discs joined together in spaced relation, said plurality of discs having a drive disc and a plurality of driven discs, said plurality of discs being received within said housing; and a shaft extending through said housing and having an end adapted to be driven by motor so as to be rotated by the motor, said shaft being affixed to the drive disc such that said plurality of discs rotate within said housing, wherein said plurality of discs comprises a center driver disc and multiple driven discs having varied outside diameters and inside diameters adapted to required efficiency and loading conditions.

16. An impeller pump comprising:

a housing having a suction chamber and a discharge chamber therein, the housing having a suction inlet opening to the suction chamber and a discharge outlet opening to the discharge chamber;

a plurality of discs joined together in spaced relationship, said plurality of discs having a drive disc and a plurality of driven discs, the drive disc being positioned centrally in a sandwiched arrangement with the plurality of driven discs, the driven disc has a pair of internal discs on opposite sides of the drive disc and a pair of external discs on opposite sides of the pair of internal discs; and a shaft extending through said housing, said housing having an end adapted to be driven by motor so as to be rotated by the motor, said shaft being affixed to the drive disc such that said plurality of discs rotate within said housing.

17. The impeller pump of claim 16, wherein each of the pair of internal discs has an internal eye of a greater diameter than a diameter of an internal eye of each of the pair of external discs.

18. The impeller pump of claim 16, wherein each of the pair of internal discs has a winglet formed on a surface thereof, the winglet being affixed to a respective surface of each of the pair of external discs, the drive disc having a first winglet on one side thereof and a second winglet formed on opposite side thereof, the first winglet being joined to one internal disc of the pair of internal discs, the second winglet being joined to another internal disc of the pair of internal discs.

19. The impeller pump of claim 16, wherein at least one of the pair of external discs and the pair of internal discs and the drive disc has a plurality of radial and angled ribs formed thereon or affixed thereto, wherein each of the plurality of radial and angled ribs extends from an internal eye of the at least one of the plurality of discs to a periphery of the at least one of the plurality of discs.

* * * * *